United States Patent [19]

Northrop

[11] 3,977,712

[45] Aug. 31, 1976

[54] VEHICLE DOOR PROP ASSEMBLY

[75] Inventor: Lyle M. Northrop, New Hampton, Iowa

[73] Assignee: Winlite, Inc., Elkhart, Ind.

[22] Filed: Sept. 7, 1974

[21] Appl. No.: 504,023

[52] U.S. Cl. ..... 292/338; 16/84
[51] Int. Cl.[2] ..... E05C 17/44; E05F 5/00
[58] Field of Search ..... 292/338; 16/84, 85

[56] References Cited

UNITED STATES PATENTS

| | | | |
|---|---|---|---|
| 1,002,812 | 9/1911 | Moore | 292/338 |
| 1,479,029 | 1/1924 | Dixon | 292/338 |
| 2,019,803 | 11/1935 | Tusher | 292/338 |
| 2,673,760 | 3/1954 | Hawks | 292/338 |
| 3,078,001 | 2/1963 | Young et al. | 292/338 |
| 3,480,247 | 11/1969 | Waner | 292/338 |
| 3,711,892 | 1/1973 | Tabor | 292/338 |
| 3,851,908 | 12/1974 | Hester et al. | 292/338 |

FOREIGN PATENTS OR APPLICATIONS

| | | | |
|---|---|---|---|
| 1,106,928 | 3/1968 | United Kingdom | 292/338 |

*Primary Examiner*—Paul R. Gilliam
*Assistant Examiner*—Victor N. Sakran
*Attorney, Agent, or Firm*—Marmaduke Hobbs

[57] ABSTRACT

A prop assembly for vehicle doors hung from the top and adapted to swing upwardly and outwardly, in which the prop assembly has a cylinder with an axial reciprocating rod connected to the door and to the door frame along the side thereof, and a spring in the cylinder urging the rod outwardly through the end of the cylinder to open the door and hold the door in open position. A fixture is pivotally connected to the end of the cylinder and another fixture is connected to the outer end of the rod, the latter fixture being secured to the door and the other fixture to the door frame. One of the fixtures consists of a base plate having an upstanding stem pivotally connected thereto for rotation on the base plate as the door is opened and closed.

7 Claims, 8 Drawing Figures

VEHICLE DOOR PROP ASSEMBLY

The bed of conventional pickup trucks is often enclosed with a cover or cap having a top, two side walls and a rear door hung from the rear edge of the top and opening outwardly and upwardly from the bottom. The door is normally latched to the two side walls with a latch operating handle and lock being located in the middle of the door near the bottom. When the door is to be opened, the handle releases the latch and the driver lifts the door and props it in open position, usually using a hand operated lever connected to one of the side walls and to the edge of the door. The operation of unlocking, opening and propping the door in open position is often difficult for women, children and men of short stature, in that they cannot easily reach the prop lever while holding the door in open position after it has been unlocked and unlatched. Further, the door may be heavy and difficult to open and close, and the manual prop is often unsafe to the operator's hands while it is being manipulated to hold or release the door. It is therefore one of the principal objects of the present invention to provide a door prop assembly for the rear door of a pickup truck cap or cover, which will automatically open or assist in opening the door after the door latch has been released, and which will hold the door in its open position until it is intentionally moved to closed position.

Another object of the invention is to provide a door prop assembly which can be readily adapted to various types and makes of doors hung from the top, and which can readily be installed on the door and door frame or facing without changing or marring the structure of either the prop assembly or door or frame.

Still another object of the invention is to provide a versatile door prop assembly of the aforesaid type which is relatively simple in construction and operation, and which can be easily fabricated using standard equipment and techniques.

A further object is to provide a vehicle door prop, particularly for the rear door of a pickup truck cap or cover, which can be installed in such a manner that it will initially resist opening of the door after it has been unlatched, thus contributing to the safety of the vehicle, in that the door will tend to remain closed in the event it is accidentally unlatched, and which is so constructed and designed that it operates in a safe manner when the door is opened and closed.

Additional objects and advantages of the invention will become apparent from the following description and accompanying drawings, wherein.

Figure 1:
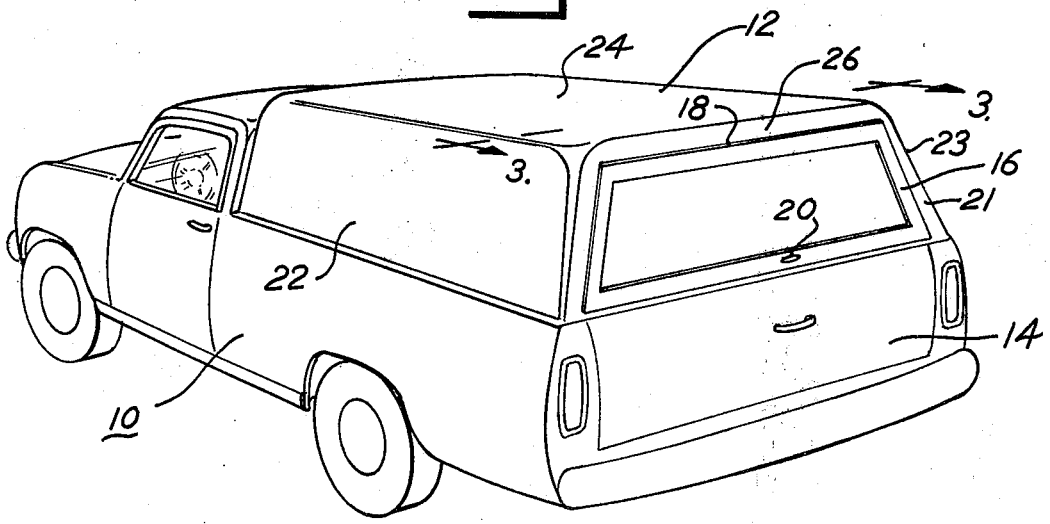
FIG. 1 is a perspective view of a pickup truck with a cap or cover thereon having a rear door with which the present door prop assembly is used, the figure showing the door in closed position.

Referring more specifically to the drawings, and to FIG. 1 in particular, numeral 10 indicates generally a pickup truck which, for the purpose of the present description, may be considered conventional, and numeral 12 indicates a cap or cover shown mounted on the bed of the truck. The pickup truck has a rear door 14 and the cap has a rear door 16, the two doors fully closing the rear of the compartment formed by the bed and cap when the two doors are in closed position. Door 16 is hung from the top of the cap on a hinge 18, and is locked by a lock 20 positioned in the middle of the door and having latches on either side for engaging fixtures in the door frame 21 attached to walls 22 and 23 of the cap. The walls of the cap are rigidly secured to top 24 and hinge 18 is connected to upper member 26 of the door frame which extends across the top and along the sides of the door and is rigidly connected to the rear edge of the top and the two side walls. The construction of the cap may be considered conventional for the purpose of the description of the invention.

Figure 2:
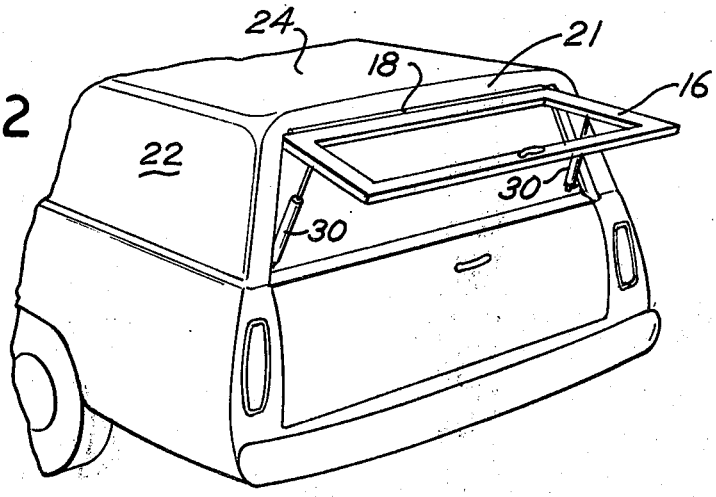
FIG. 2 is a fragmentary perspective view of the pickup truck shown in FIG. 1, showing the door being held in open position by the present door prop assembly.
Figure 3:
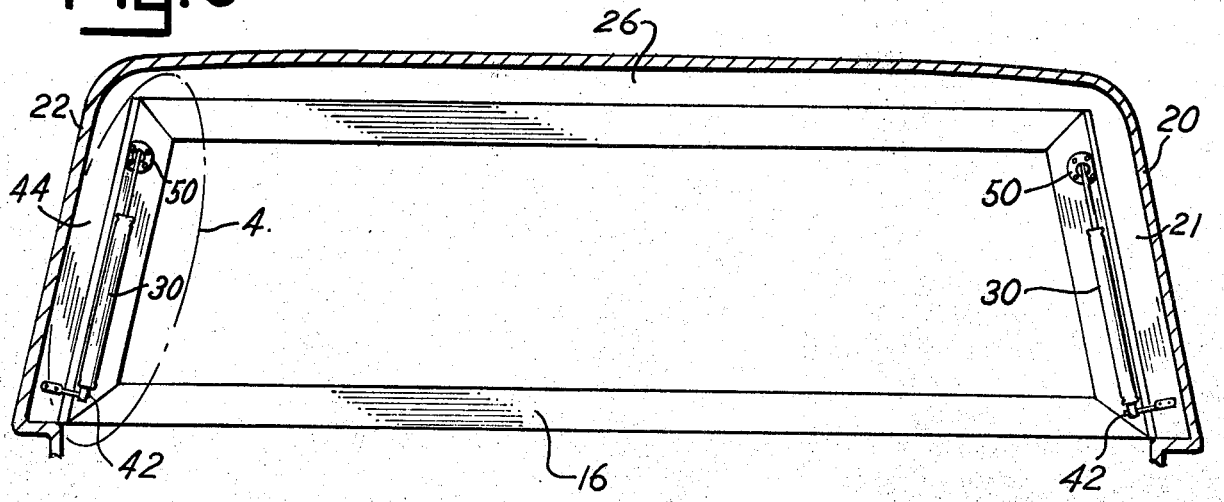
FIG. 3 is a horizontal cross sectional view of the cap or cover on the pickup truck showing two door prop assemblies embodying the present invention mounted thereon.
Figure 4:
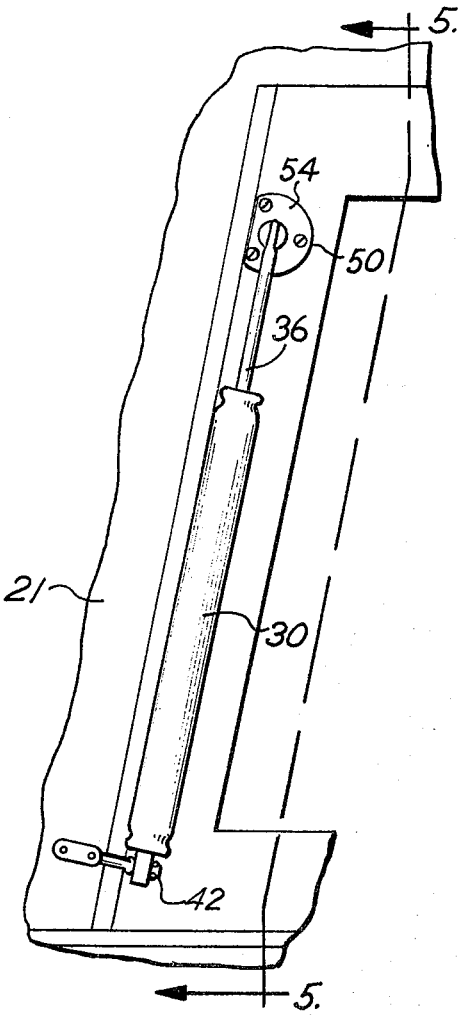
FIG. 4 is a fragmentary elevational view of the present door prop assembly, showing it mounted in operating position on the door and door frame of the cap or cover seen in FIGS. 1, 2 and 3.
Figure 5:
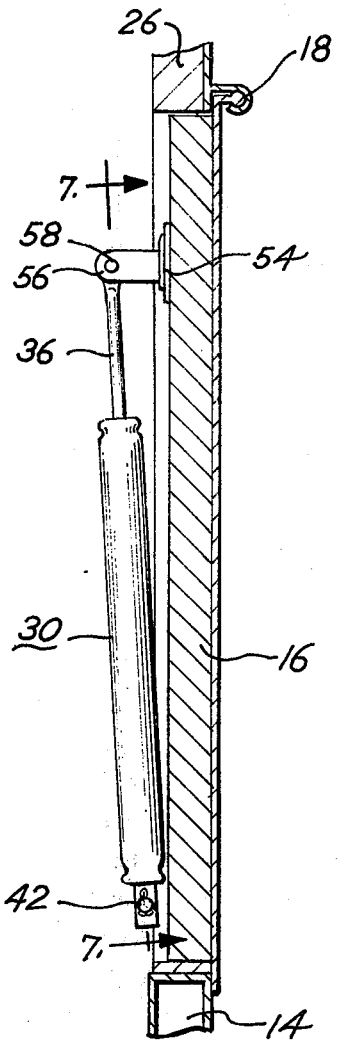
FIG. 5 is a vertical cross sectional view of the door of the cap or cover and an elevational view of the door prop assembly mounted thereon.

The door prop assembly 30 embodying the present invention is normally mounted along the side of the door, and two door prop assemblies may be used as illustrated in FIGS. 2 and 3, with one at each side of the door. One door prop may be sufficient to properly support the door; however, a balanced operation is more likely to be obtained if two prop assemblies or units are used.

Figure 7:
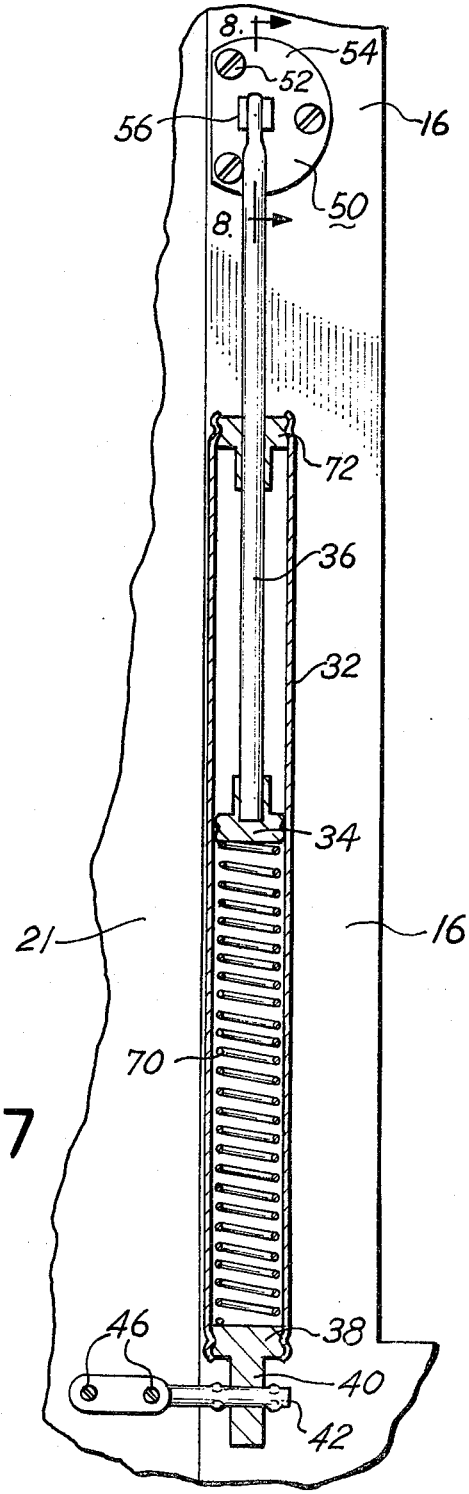
FIG. 7 is a vertical cross sectional view of the present door prop assembly, the section being taken on line 7—7 of FIG. 5.

The construction of the door prop, which is best illustrated in FIG. 7, consists of a cylinder 32 having a piston 34 therein connected to the inner end of a rod 36. The lower end of cylinder 32 is closed by an end member 38, which has an extension 40 pivotally connected to a fixture 42, which in turn is secured to the frame 44 of the door by screws 46 extending through the fixture into the door frame. The outer end of rod 36 is pivotally connected to a fixture 50, which in turn is secured to the door by a plurality of screws 52. Fixture 50 has a base plate 54 through which the screws extend, and which is rigidly secured to the face of the door structure, and an upstanding stem 56, which is connected to the end of rod 36 by a pin 58, pivotally connected to base plate 54 by an extension 60 of the lower end of stem 56, projecting through a hole 62 in the center of base plate 54, thus permitting the stem to rotate fully and freely on its longitudinal axis. The cylinder and rod are preferably constructed of metal, and the upper and lower end members and the piston may be constructed of plastic. However, the particular types of materials used are not important so long as they are capable of giving satisfactory performance and durability.

The rod 36 is urged outwardly from the cylinder by a coil spring 70 disposed in the cylinder between the lower side of piston 34 and the upper side of end member 38, urging the rod outwardly through an opening in upper end member 72, which serves as a guide and stabilizer for the rod. With the pivoted connections at the bottom of the cylinder and the upper end of the rod, the assembly or unit will readily adapt itself to various movements of the door with respect to the frame as the door is opened and closed without causing any binding or resistance to the operation of either the door or prop assembly. The spring rate and force are such that they will more than counterbalance the weight of the door, so that when the door is unlatched and moved to a slightly open position the spring will lift the door and hold it in an open position until it is intentionally moved to its closed position.

Figure 6:
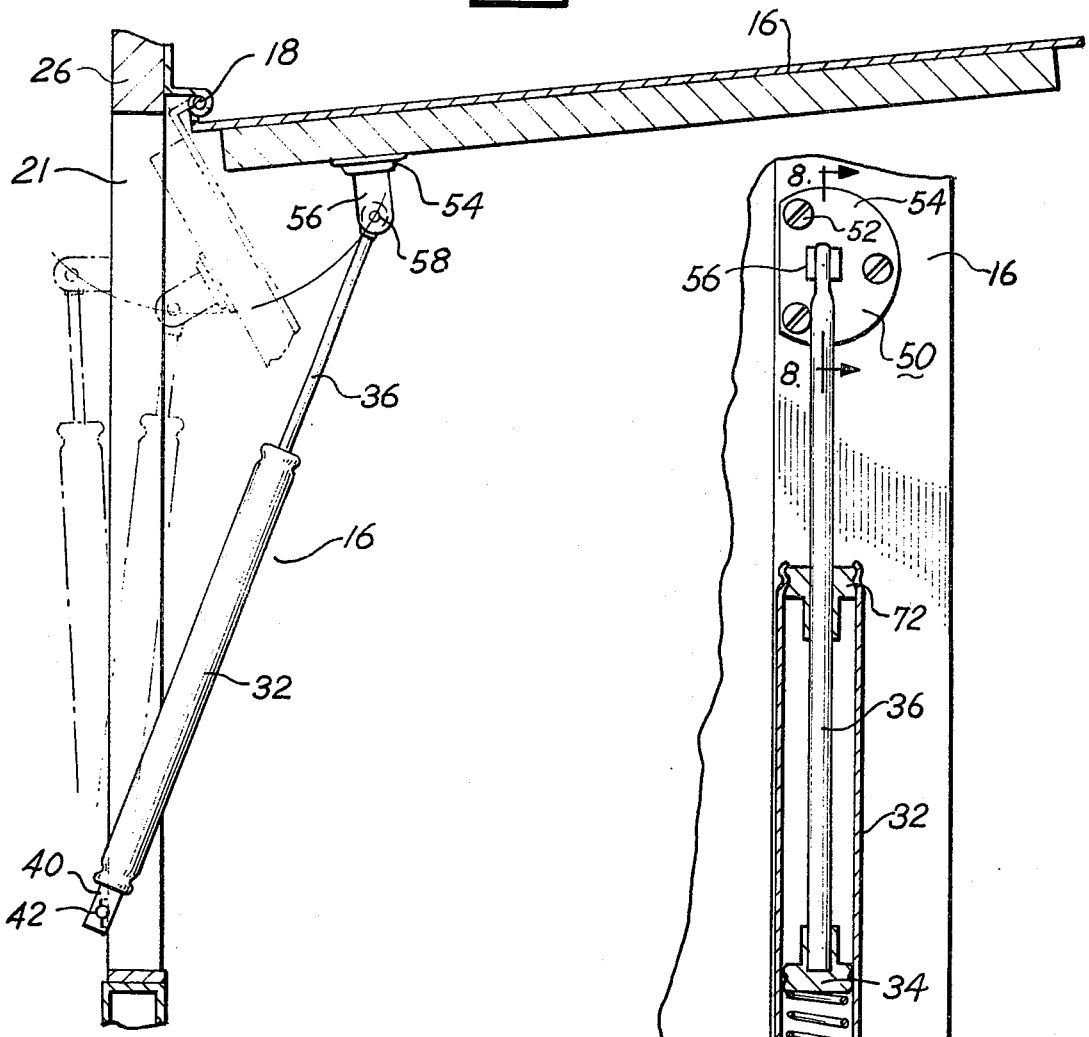
FIG. 6 is an elevational view similar to that illustrated in FIG. 5 but showing the door in its open position.
Figure 8:
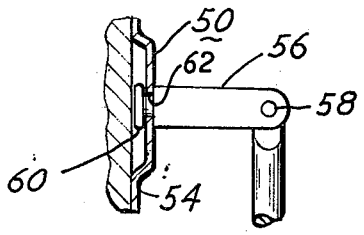
FIG. 8 is a cross sectional view of one of the fixtures for connecting the prop assembly to the door of a cap or cover for a pickup truck, the section being taken on line 8 - 8 of FIG. 7.

In the installation and operation of the present vehicle door assembly, the door prop assembly 30 is attached to the door frame and door in the manner illustrated in the drawings, with the cylinder parallelling but being spaced inwardly from the door frame so that it will pass freely along the edge thereof as the door is opened. When the door is latched, the door prop assembly is in the position best illustrated in FIG. 2, with the cylinder extending angularly inwardly from the bottom fixture to the upper fixture. Thus, the force of the spring on the rod applies a slight force in the direction to close and restrain the opening of the door. When the line of force between the two fixtures has passed the line between the lower fixture and hinge 18, the force of the spring then applies a lifting force on the door and the resistance to the opening of the door is completely eliminated. As the door swings outwardly, the prop assembly applies a greater effective force against the door, thereby compensating for the increasing weight of the door as it is swung outwardly and upwardly. When the door has been fully opened, i.e. into the position illustrated in FIG. 6, the prop assembly is in a relationship to apply the greatest effective force as a result of the geometric relationship of hinge 18, fixture 42 and fixture 50. It is seen in FIG. 6 that the line between the pivot points on the two fixtures moves angularly outwardly, passing the line between fixture 42 and hinge 18 and continuing outwardly until it reaches the position shown in full lines in FIG. 6, the resistance provided by the prop assembly first diminishing to zero when the line between the two fixtures crosses the line between the lower fixture and the hinge. Thereafter, an increasing force is applied to the door by the prop assembly, notwithstanding the fact that the expansion of coil spring 70 has taken place. During the movement of the prop assembly between the two positions, the relationship of the door to the fixture may change, thus requiring stem 56 to pivot on base plate 54 to avoid any binding or resistance from the changing relationship.

When the door is to be closed, the operator merely presses down on the outward or lower edge of the door, pushing the door inwardly to its latched position. While this is taking place, rod 36 is pressed inwardly into cylinder 32, compressing coil spring 70. After the line between the two fixtures has passed the line between the lower fixture and hinge in the closing operation, the force of the spring on rod 36 urges the door to closed position. This is a safety feature, in that if the door becomes accidentally unlatched or was improperly closed, the force urging the door to closed position may prevent the door from swinging open. The resistance, however, is not of such magnitude that it will seriously interfere with intentional opening of the door.

While only one embodiment of the present door prop assembly has been described in detail herein, various changes and modifications may be made without departing from the scope of the invention.

I claim:

1. A prop assembly for a door unit and a frame unit with the door unit being hung from the top and adapted to swing upwardly to approximately a horizontal position, said prop assembly comprising a cylinder having a member in one end, a rod disposed in axial parallel relation in said cylinder and projecting outwardly from the other end, a fixture pivotally connected on a transverse axis to the end of said cylinder opposite said rod and having a laterally extending member for securing said assembly to a supporting member on one of said units, a fixture pivotally connected to the outer end of said rod for connection to the other of said units and having a base member and an upstanding stem connected perpendicularly to said base member for axial rotation thereon, pivot means connecting said stem to said rod for pivotal movement relative thereto, said pivot means having a connecting pin disposed on an axis transverse to said stem, and a spring means in said cylinder reacting between said end member and said rod for urging said rod outwardly to lift the door unit and to hold it in open position and said stem on said second mentioned fixture being sufficiently long to cause said spring and rod to exert a pressure in the direction to urge the door unit toward closed position when it approaches said position.

2. A prop assembly for a door as defined in claim 1 in which a piston is mounted on the inner end of said rod, and said member in one end of said cylinder is an end wall, and said spring reacts between said end wall and said piston.

3. A prop assembly for a door as defined in claim 2 in which said spring means is a coil spring.

4. A prop assembly for a door as defined in claim 2 in which said first mentioned fixture projects laterally from said cylinder and is adapted to be secured to said frame unit.

5. A prop assembly for a door as defined in claim 1 in which said second mentioned fixture includes a relatively flat base plate for mounting on the door unit and said stem is pivotally connected to the center of said base plate and projects outwardly therefrom for rotation on its longitudinal axis.

6. A prop assembly for a door as defined in claim 2 in which said second mentioned fixture includes a relatively flat base plate for mounting on the door unit and said stem is pivotally connected to the center of said base plate and projects outwardly therefrom for rotation on its longitudinal axis.

7. A prop assembly for a door as defined in claim 6 in which a member is mounted in said other end of the cylinder and is provided with an opening therein through which said rod reciprocates.

* * * * *